United States Patent [19]

Radey, Jr.

[11] 4,233,998

[45] Nov. 18, 1980

[54] SMOKING APPARATUS

[76] Inventor: Ross T. Radey, Jr., 947 Clopper Rd., Apt. B-3, Gaithersburg, Md. 20760

[21] Appl. No.: 918,677

[22] Filed: Jun. 23, 1978

[51] Int. Cl.[3] ..... A24F 13/16; A24F 13/12

[52] U.S. Cl. ..... 131/175; 131/178; 46/175 R

[58] Field of Search ..... 131/175, 174, 178, 176; 46/175

[56] References Cited

U.S. PATENT DOCUMENTS

| | | | |
|---|---|---|---|
| 1,118,828 | 11/1914 | Thomas | 131/175 |
| 1,523,567 | 1/1925 | Surdek et al. | 131/175 |
| 1,553,178 | 9/1925 | Leddy | 131/175 |
| 3,336,929 | 8/1967 | Williams | 131/175 |
| 3,340,647 | 9/1967 | Lathrop | 46/175 X |

*Primary Examiner*—Stephen C. Pellegrino

[57] ABSTRACT

A cigarette smoking apparatus is provided, in which a cigarette may be mounted to protect it from the wind, and which acts as an ashtray, collecting ashes, sparks, and the like. A cigarette holder is sized to receive and hold a cigarette and is supported in a hose which is attached to a chamber and filter casing. The casing has an enlarged chamber and a removably mounted filter therein, and a removably mounted mouthpiece attached thereto. The wind protecting sleeve may have a hinged lid attached thereto, and a whistle slot formed therein.

5 Claims, 3 Drawing Figures

SMOKING APPARATUS

BACKGROUND OF THE INVENTION

The present invention relates to a smoking device, and especially to a smoking device for smoking cigarettes and the like, which has a filter chamber and filter compartment along with means to support a cigarette therein and an encircling sleeve for the cigarette to protect the cigarette from wind while collecting ashes, sparks, and the like.

In the past, it has been common to provide a great variety of pipes for smoking loose tobaccoes, which sometimes contain removably mounted filters therein. The typical pipe includes a bowl connected through a stem to a mouthpiece so that the tobacco can be burned in the bowl and drawn through the stem by the user. The filter is placed in the stem or mouthpiece. Cigarette holders typically have only a stem and mouthpiece, and frequently have a filter compartment for holding a filter so that the user can smoke a filterless cigarette and have the benefit of a filter. The mouthpieces are frequently removable so that the stem can be cleaned.

The present invention is directed towards a combination in which a cigarette holder is mounted to an elbow-shaped casing which has both a filter chamber and a removable filter mounted therein and includes in the combination, an encircling wind protecting sleeve which with the mounting base acts as an ashtray for collecting ashes, sparks, and the like, from the smoking of a cigarette, and in addition may also incorporate an integral whistle which is actuated by blowing through the mouthpiece.

SUMMARY OF THE INVENTION

A smoking apparatus is provided having an elbow-shaped chamber and filter casing with a passageway therethrough and a chamber and filter holding compartment formed therein. A mouthpiece is removably attachable to the chamber and filter casing at one end of the passageway therethrough while a sleeve, base and cigarette holding means is removably mounted to the other end of the passageway. A cigarette may be mounted in a holder and inserted into the base member and a sleeve mounted thereover so that the sleeve and the base form an ashtray and wind protecting cylinder for the cigarette. A hinged lid may be mounted to the sleeve and a slot may be formed therein to form a whistle with the smoking device.

BRIEF DESCRIPTION OF THE DRAWINGS

Other objects, features, and advantages of the present invention will be apparent from the written description and the drawings, in which.

DESCRIPTION OF THE PREFERRED EMBODIMENT

Figure 1:
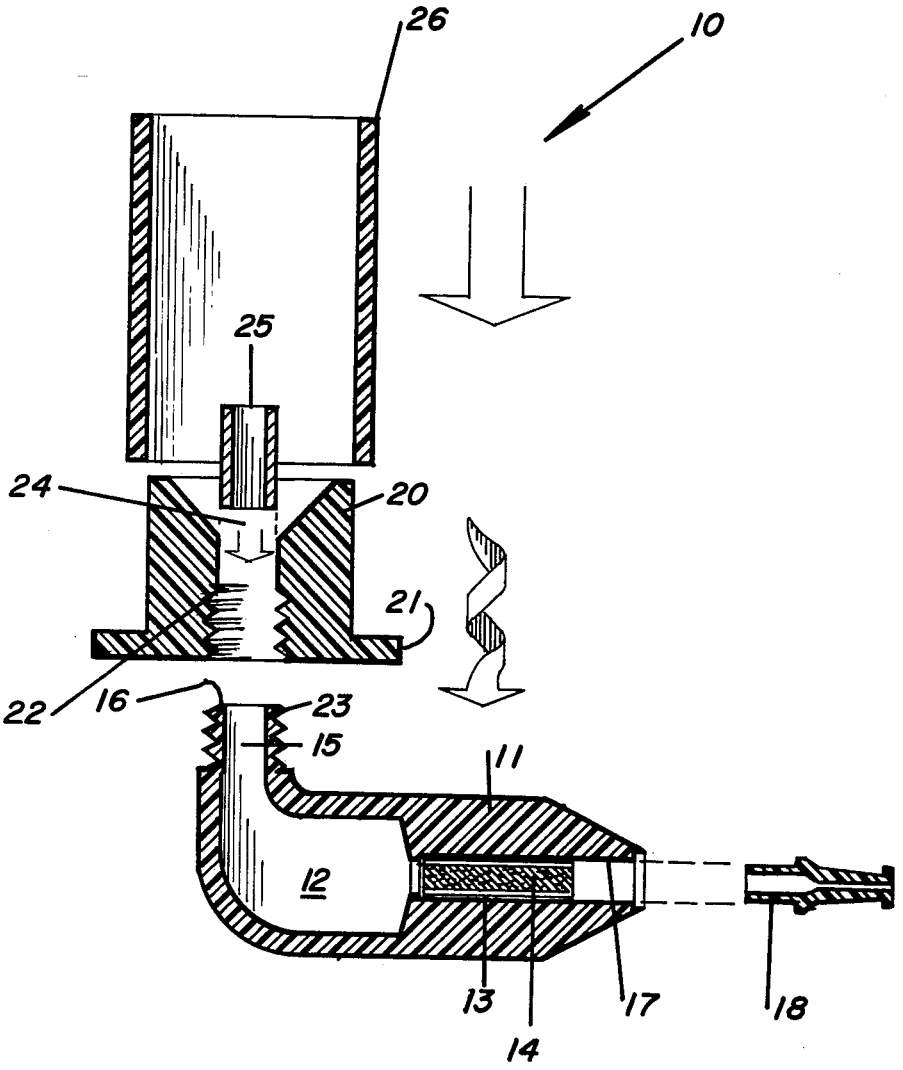
FIG. 1 is an exploded sectional view of a smoking apparatus in accordance with the present invention.

Referring to FIG. 1 of the drawings, a smoking apparatus 10 is provided with a chamber and filter casing 11 having an enlarged chamber 12 therein, and a filter holding compartment 13 having a filter 14 therein. A passageway 15 is connected from an opening 16 through the chamber 12, filter compartment 13, and an opening 17 at the other end thereof. The opening 17 allows for the mounting of a removably mouthpiece 18. A cylindrical base member 20 has a flanged portion 21 and internal threads 22 for connecting to external threads 23 of the chamber and filter casing 11. Base member 20 has a passageway 24 therethrough shaped to receive a cigarette holding member 25. An enlarged sleeve 26 is sized to fit over the base member 20 and against the flanged portion 21 so that sleeve 26 and base 20 together form an ashtray for a cigarette mounted in the cigarette holder 25 while collecting ashes, sparks, and the like, from the smoking of the cigarette. In addition, the sleeve 26 acts as a wind protecting sleeve. It is anticipated that the casing 11 will be made of metal, while the base 20 will be made of a polymer meterial, and the cigarette holder 25 will be made of metal, and sleeve 26 and mouthpiece 18 of a polymer material. However, other materials can be utilized without departing from the spirit and scope of the invention.

Figure 2:
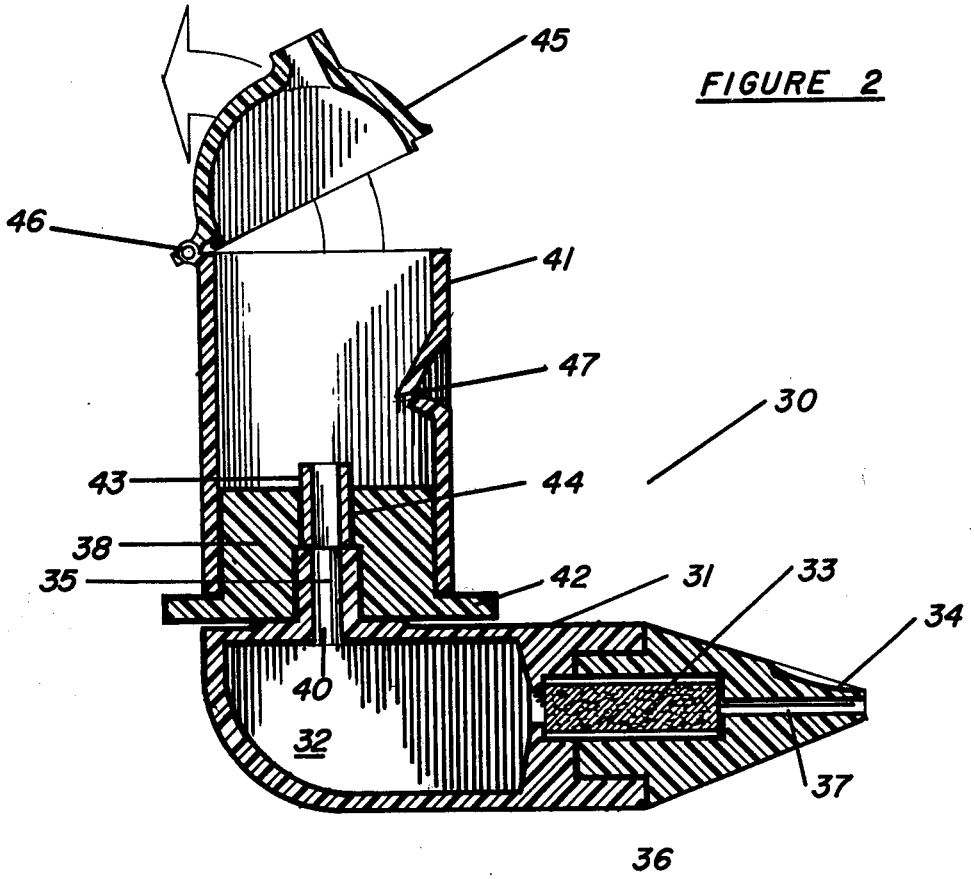
FIG. 2 is a sectional view of a second embodiment of a smoking apparatus in accordance with the present invention.
Figure 3:
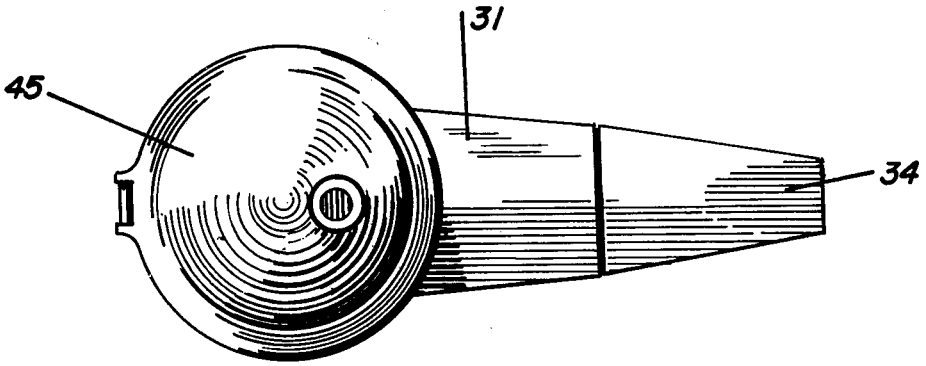
FIG. 3 is a top elevation of the smoking apparatus of FIG. 2.

FIGS. 2 and 3 illustrate a second embodiment of a smoking apparatus 30 having a casing 31 with a chamber 32 and a filter 33 mounted therein with a mouthpiece 34 covering the filter 33. A passageway through the casing 31 connects an opening 35 through the chamber 32, filter compartment 36, and mouthpiece 34 to passageway 37. A support base 38 is attached through the protruding portion 40 of the chamber 31 by a threaded connection or the like, and has a sleeve 41 mounted thereover against a flanged portion 42. A small cylindrical cigarette holder 43 is mounted in the base opening 44 for receiving a cigarette therein, which then protrudes vertically inside the cylinder 41. The cylinder 41 has a lid 45 hinged at 46 and a whistle opening 47 therein. A cigarette mounted in a cigarette holder 43 may be smoked through the passageway 35, chamber 32, filter 33, and mouthpiece 34, while the sleeve 41 in combination with the base 38 collects ashes, and the like, with the sleeve 41 also acting as a wind break to protect the cigarette from the wind, and lid 45 allows the system to protect the cigarette from the wind, and lid 45 allows the system to be covered when not in use, while the whistle slot 47 allows the user to generate a whistling noise when the lid 45 is closed, and the mouthpiece 34 is drawn upon.

Advantageously, the chamber 12 in FIG. 1 or chamber 32 in FIG. 2 can be filled with tobacco and smoked as a pipe with or without a cigarette in the cigarette holder and with or without the base and sleeve.

It should be clear at this point that a smoking apparatus has been provided, but it should also be clear that variations in the structure and materials are contemplated as being within the scope of the invention. Accordingly, the present invention is not to be construed as limited to the particular forms disclosed herein, which are to be regarded as illustrative rather than restrictive.

I claim:

1. A smoking apparatus comprising in combination:

a chamber and filter casing having a passageway therethrough connecting a chamber therein and a filter holding compartment adjacent to said chamber;

a mouthpiece removably mounted to said chamber and filter casing;

cigarette holding means attached to said chamber and filter casing for mounting a cigarette therein;

a cylindrical sleeve removably mounted to said cigarette holding means for encircling a cigarette mounted in said cigarette holding means to confine said cigarette from wind, and to collect ashes and the like therein;

a hinged lid attached to said cylindrical sleeve by a hinge; and a whistle slot formed in the side of said cylindrical sleeve whereby drawing upon said smoking apparatus will generate a whistling sound when said hinged lid is closed.

2. The apparatus in accordance with claim 1, in which said cigarette holding means includes a base member having a cigarette holding member removably mounted therein, and a cylindrical sleeve mount formed thereon.

3. The apparatus in accordance with claim 2, in which said cigarette holding member is a metal sleeve which slips into said base member.

4. The apparatus in accordance with claim 3, in which said chamber and filter casing are elbow-shaped.

5. The apparatus in accordance with claim 4, in which said base member is a cylindrical member having a cylindrical opening therein for holding a cigarette holding member and has a flanged portion for supporting said cylindrical sleeve, whereby said base member and cylindrical sleeve form an ashtray for a cigarette mounted in said cigarette holder supported on said base member.

* * * * *